United States Patent [19]

Skillen

[11] Patent Number: 4,470,539

[45] Date of Patent: Sep. 11, 1984

[54] MULTI CELLULAR DIVIDER

[75] Inventor: William R. Skillen, London, Canada

[73] Assignee: Somerville Belkin Industries Limited, London, Canada

[21] Appl. No.: 428,598

[22] Filed: Sep. 30, 1982

[51] Int. Cl.[3] ..... B65D 5/48

[52] U.S. Cl. ..... 229/28 BC; 206/427

[58] Field of Search ..... 229/28 BC, 15, 42; 206/427

[56] References Cited

U.S. PATENT DOCUMENTS 3,070,276 12/1962 Richardson ..... 229/28 BC 3,980,223 9/1976 Curran ..... 229/15

*Primary Examiner*—Herbert F. Ross

*Attorney, Agent, or Firm*—Fetherstonhaugh & Co.

[57] ABSTRACT

A divider blank comprising four hinged strips serially arranged with their longitudinal axes parallel, said strips being an end strip, two middle strips and an end strip; divider flaps cut from and hingedly connected to each of the strips; the ends of the divider flaps of the end strips being adhesively connectable to the ends of the divider flaps of their respective hinged middle strip when they are caused to be moved to overlying relation whereby to form a divider between their respective strips; the outer strips being adhesively connectable to form a composite strip upon first folding the end strips over their respective adjacent strips and then folding the outside strips to overlie each other; the hinged connection between the middle strips being severable when they are caused to overlie each other as aforesaid; said divider panels when adhesively connected as aforesaid to form dividers interconnecting said composite strip and said middle strips and being adapted to space the strips as the divider panels hinge from their respective panels to articulate the assembly to define four series of divided cells; anchor flaps on the strips and on the dividers for connection to the walls of a container to impart spreading motion to the strips and dividers as the container is moved from a flat to a set-up position.

2 Claims, 7 Drawing Figures

MULTI CELLULAR DIVIDER

This invention relates to a divider construction of the type used to separate bottles into rows along and across a paperboard container.

The invention has a particular application to a divider construction for beer bottles. In the embodiment of the invention illustrated the divider is adapted to separate twenty-four beer bottles into four rows of six bottles each within a paperboard container.

In the beer industry it is common practice to package beer in a paperboard container having a closable top wall and a divider construction to separate, say twenty-four bottles into four rows of six bottles each. The dividers are made from slotted interconnecting strips which form a lattice work divider. Dividers are separately formed from a container and after the container is set up, a packaging line attendant must insert the divider into the set-up container prior to loading of the beer into the container. The cost of the attendant adds appreciable cost to the packaging of beer.

In many localities empty beer bottles are returned in the shipping containers for reuse. It is customary to remove the bottles from the containers by machine and subsequently to reclaim the dividers by hand from the containers for reuse. It is not practice to reuse the containers because they are usually marked or defaced. The cost of the dividers, however, is such that it is worthwhile reclaiming at least the better dividers that are returned.

It is an object of this invention to provide an economic divider construction that can be glued into the container when the container is in a knocked down condition and that will be automatically set up to receive the bottles as the container is actuated from its lay-flat knock down condition to its set up condition.

The divider according to this invention is made from a single blank and is relatively inexpensive so that it can be disposed of with the container. It will reduce the overall cost of packaging beer.

Generally speaking, the divider blank for making a divider according to this invention comprises a divider blank comprising four hinged strips serially arranged with their longitudinal axes parallel, said strips being an end strip, two middle strips and an end strip, divider flaps cut from and hingedly connected to each of the strips, the ends of the divider flaps of the end strips being adhesively connectable to the ends of the divider flaps of their respective hinged middle strip when they are caused to be moved to overlying relation whereby to form a divider between their respective strips, the outer strips being adhesively connectable to form a composite strip upon first folding the end strips over their respective adjacent strips and then folding the outside strips to overlie each other, the hinged connection between the middle strips being severable when they are caused to overlie each other as aforesaid, said divider panels when adhesively connected as aforesaid to form dividers interconnecting said composite strip and said middle strips and being adapted to space the strips as the divider panels hinge from their respective panels to articulate the assembly to define four series of divided cells, anchor flaps on the strips and on the dividers for connection to the walls of a container to impart spreading motion to the strips and dividers as the container is moved from a flat to a set-up position The invention will be clearly understood after reference to the following detailed specification read in conjunction with the drawings.

IN THE DRAWINGS

Figure 1:
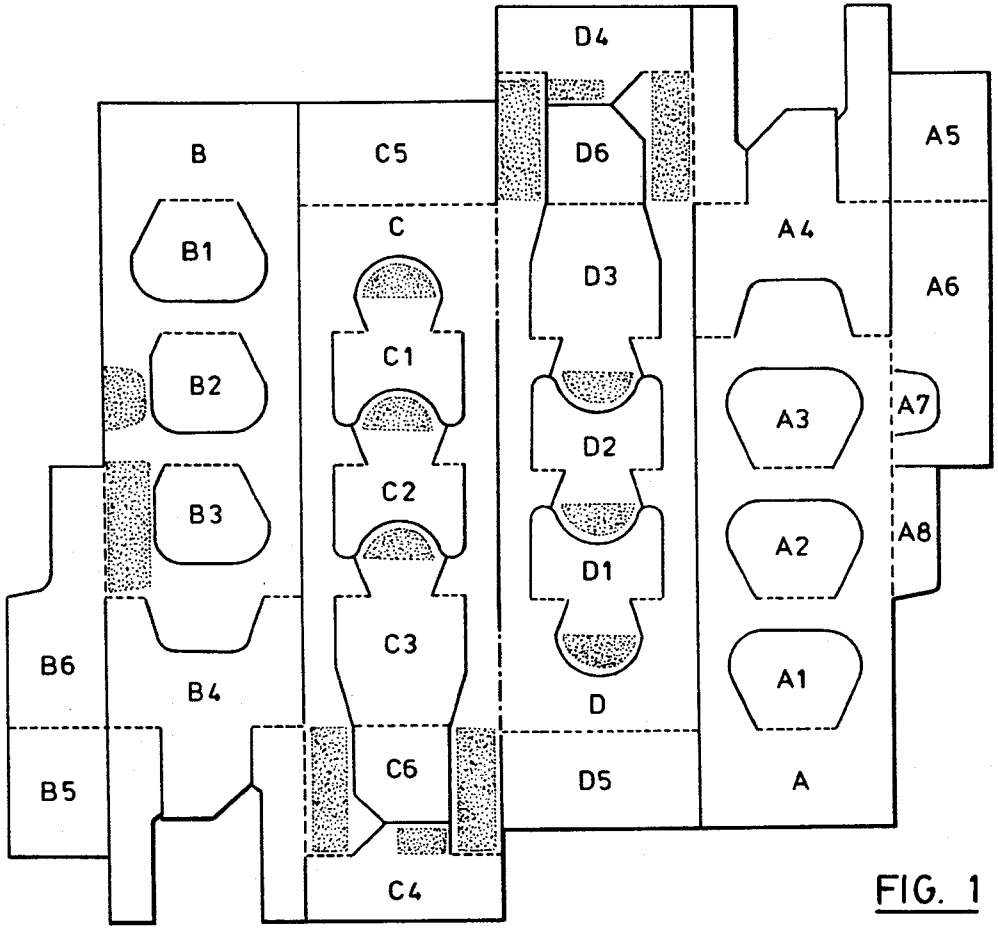
FIG. 1 is an illustration of a blank from which a divider according to this invention can be formed.

The embodiment of the invention illustrated in the drawings is made from a single blank that has four hinged strips serially arranged with their longitudinal axes parallel. These strips are generally indicated by the letters A, B, C and D.

Each of the strips has flaps cut therefrom and hingedly connected thereto. The flaps of each of the strips have been indicated by the letter of the strip, together with a subscript. The strip A has flaps A1, A2, A3 and A4.

The strip B has divider flaps B1, B2, B3 and B4.

Strip C has divider flaps C1, C2, C3 and C4.

Strip D has divider flaps D1, D2, D3 and D4. In addition, strip A has a divider flap A5 that is hinged to the foldover strip A6, and tabs A7 and A8. Similarly, strip B has a divider flap B5 that is hinged to fold-over strip B6.

Strip C has an anchoring flap C5. Similarly, strip D has an anchoring flap D5.

Divider flap C3 has an anchoring flap C6. Similarly, divider flap D3 has an anchoring flap D6.

The blank illustrated in the drawings is formed with cut lines indicated by a light solid line; hinge lines indicated by a broken line of equal short length; and breakable perforated lines indicated by an alternate long and short broken line which are adapted to break on folding.

Figure 3:
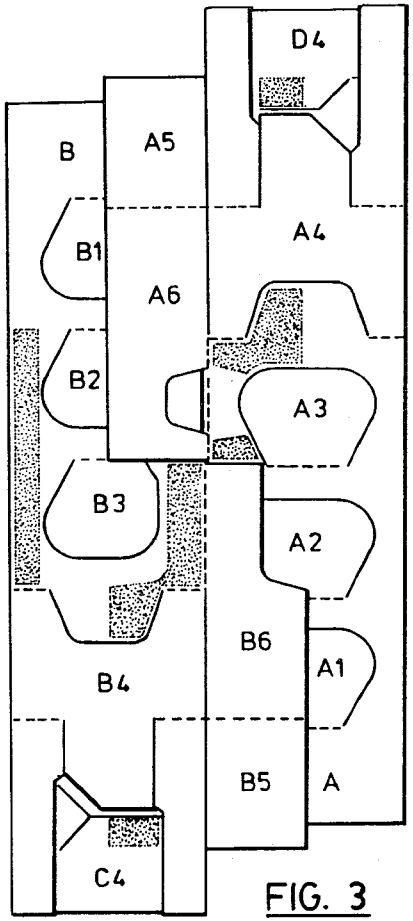
FIG. 3 is an illustration showing the first folding operation completed.
Figure 2:
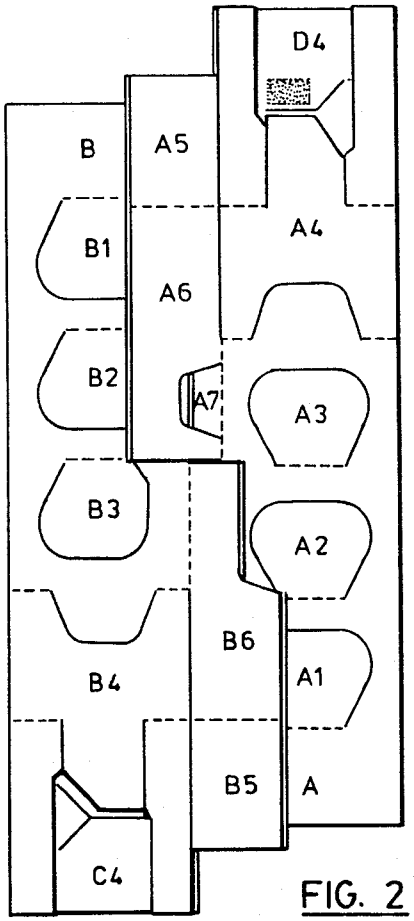
FIG. 2 is an illustration showing the first folding of the blank in the progress of being made; it will be noted that the edge of panel B is not yet flat against panel C.

In order to assemble a divider assembly from the blank, one applies adhesive to panels B, C and D at the locations indicated by the adhesive hatching in FIG. 1. One, then folds panels A and B inwardly with panel B slightly ahead of panel A at the start of the fold as indicated in FIG. 2 to ensure that the edge of B panel will engage the face of fold over strip A6 and anchor flap A5. As the fold progresses, panel A6 folds lightly about its crease line to permit the tab A7 which is cut therefrom to underlie panel B and to engage with the adhesive thereon. Tab A8 similarly engages with the underside of panel B and is adhered thereto. With this fold, as illustrated in FIG. 3, panels A and B are adhesively united at tabs A7 and A8; the dividers of panels B and C are adhered together; and the dividers of panel A and D are adhered together. Fold over strip A6 and its tab A5 overlie panel B. Fold over strip B6 and its tab overlie panel A.

The first fold having been completed, adhesive is applied to the surfaces of panels A and B at the locations hatched in FIG. 3. This adhesive is on the opposite sides of these panels to that applied in FIG. 1.

The adhesive applied, panel A is folded onto panel B to further adhesively secure panels A and B and to locate their respective fold over strips. In the folding operation, the perforated line connection between panels C and D is broken to separate these panels. Thus strips A and B are adhesively laminated and strips C and D are free to provide three longitudinal divider elements.

Figure 6:
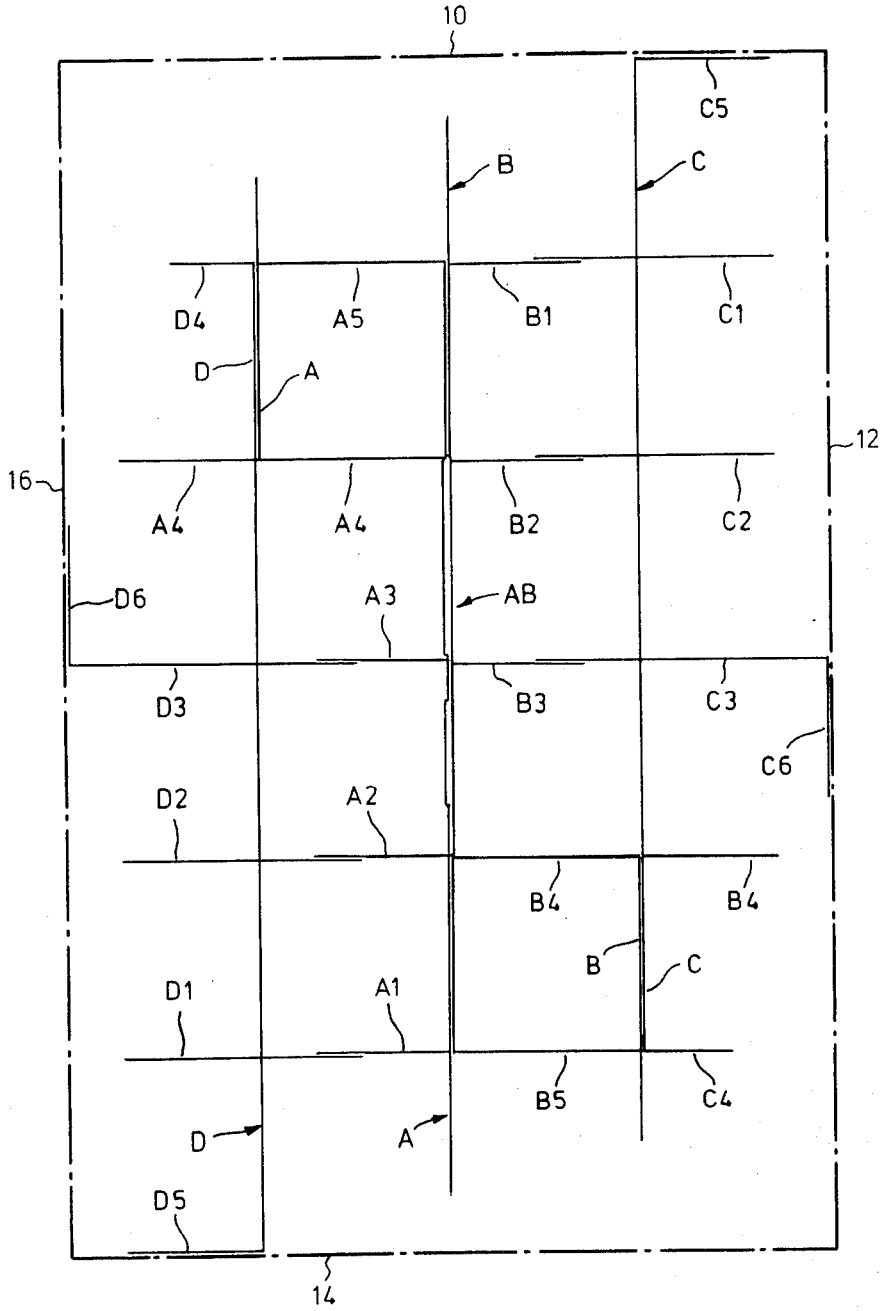
FIG. 6 is a view similar to FIG. 5 showing the container in a set-up position.

The divider is now fully constructed. The adhesive is pressed and set following which, the longitudinal dividers can be separated to the position illustrated in FIG. 6 by moving the longitudinal strips C and D longitudinally of each other.

In use, the tabs D6, C6, D5 and C5 are adhesively secured to the interior sidewalls and end walls respectively of a container when the container and the divider assembly are each in a knock-down condition. This is done as the container is being manufactured so that as the container is shipped in its knockdown lay-flat condition, it has a folded divider construction between its walls. A person skilled in the art would have no difficulty for inserting dividers in a container on a production basis as the containers are manufactured. As the container is set up from a knock-down to a set-up position, the divider assembly is automatically articulated to a set-up position.

Figure 7:
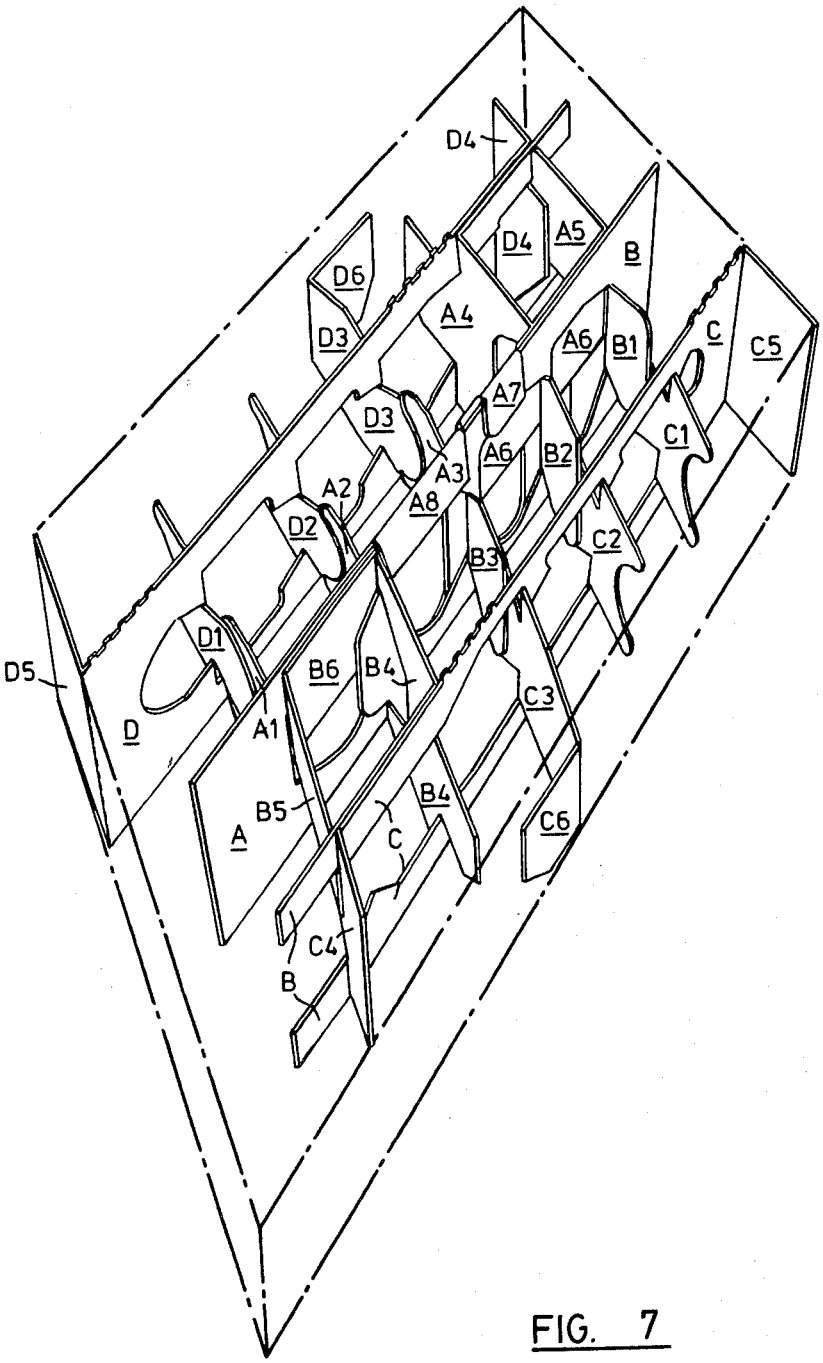
FIG. 7 is a perspective illustration of the divider in the set-up condition within the four walls of a container.

In FIG. 7, the divider assembly is illustrated in perspective in a container, the walls of the container being illustrated by long and short broken lines.

The standard chip board container illustrated is manufactured and shipped to the user in knock-down form with one end and side wall laying in juxtaposed position to the other end and side wall and with the flaps that form the top and bottom extending outwardly from their respective end and side walls. The first step in setting up a container of this nature is to push opposed end walls toward each other to cause the end and side walls to assume a set-up position. After the end walls and side walls are in the set position, the flaps that form the bottom are actuated into place and glued, the container is filled and the top is closed. The bottom and top have not been illustrated to avoid undue complication of the drawings.

Figure 5:
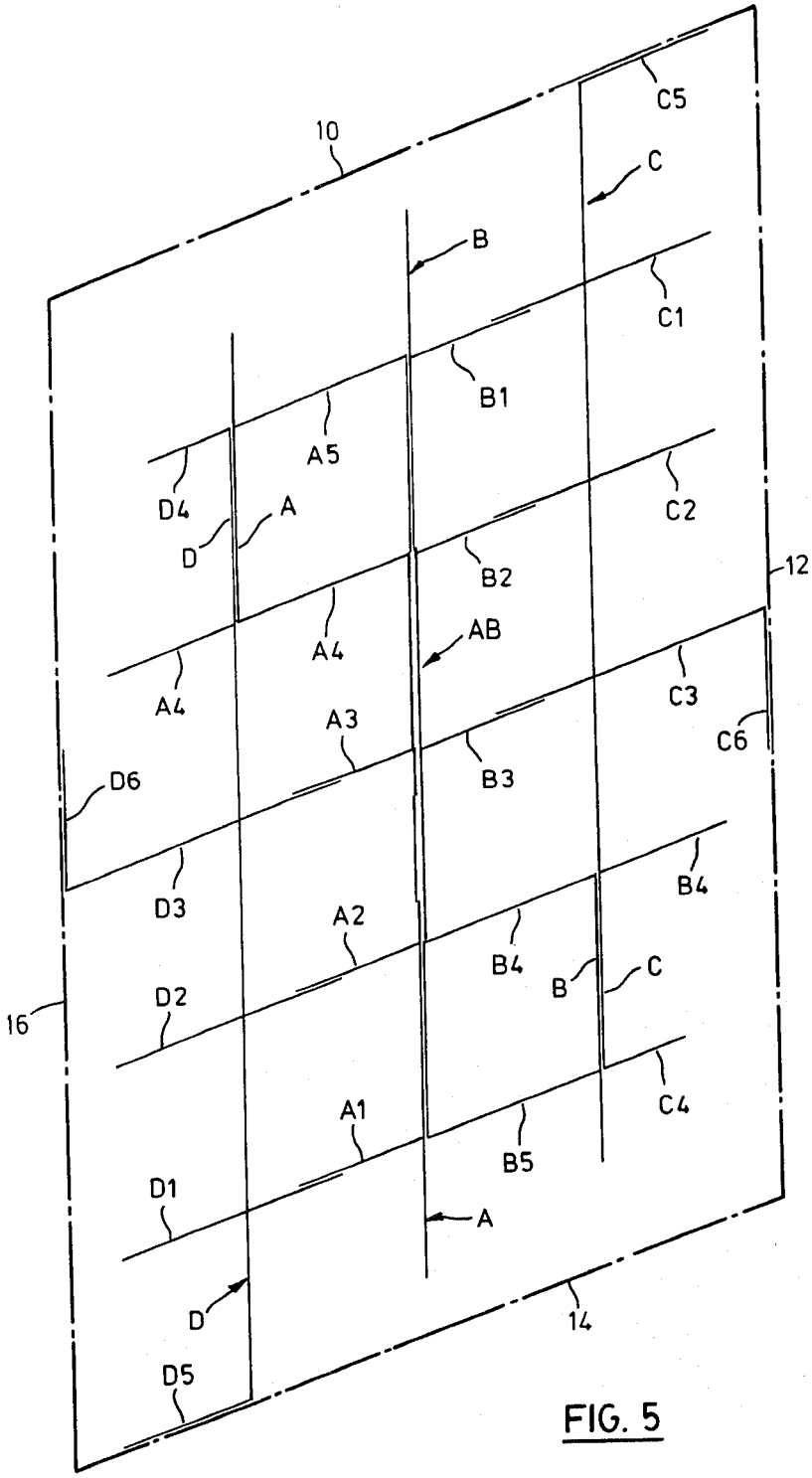
FIG. 5 is a schematic illustration showing the manner in which the divider is being set up.

The divider construction of this invention is glued into the knock-down container and as noted anchor flaps C5, C6, D5 and D6 are adhesively secured to the end wall 10, side wall 12, end wall 14 and side wall 16 respectively. FIG. 5 illustrates the arrangement of the end and side walls of such a container in the partially set-up positions. It will be apparent that as the end walls and side walls move to the lay-flat storage position that the divider will collapse and assume a lay-flat strip form between the end and side walls . Similarly, as the container is moved to the set-up position, the divider is articulated to the set-up position as indicated in FIG. 5 due to the interconnection of the anchoring flaps and the inside walls of the container.

Figure 4:
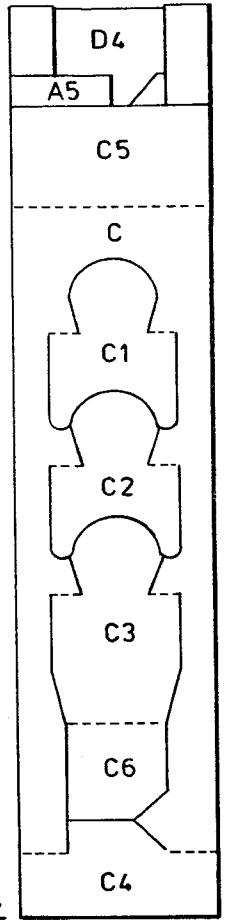
FIG. 4 is an illustration showing the second folding operation.

FIG. 7 is a perspective illustration. It will be appreciated that the end and side walls of the container have been indicated in a broken line construction only and that the bottom and top walls of the container have not been illustrated. These things are well known and it is not thought necessary that they be illustrated in the drawings. The principle concern in this case is to illustrate how the divider can be secured into such a container and how it is articulated from the folded position indicated in FIG. 4 to the set-up position as the container is moved from the knocked-down to the set-up position.

The invention has been described in relation to a beer container but it will be apparent that it has application to other containers and in other sizes than that illustrated. It is not intended that the specific embodiment of the invention illustrated should be read in a limiting sense.

The embodiments of the invention in which an exclusive property or privilege is claimed are defined as follows:

1. A divider blank comprising four hinged strips serially arranged with their longitudinal axes parallel, said strips being an end strip, two middle strips and an end strip;

divider flaps cut from and hingedly connected to each of the strips;

the ends of the divider flaps of the end strips being adhesively connectable to the ends of the divider flaps of their respective hinged middle strip when they are caused to be moved to overlying relation whereby to form a divider between their respective strips;

the outer strips being adhesively connectable to form a composite strip upon first folding the end strips over their respective adjacent strips and then folding the outside strips to overlie each other;

the hinged connection between the middle strips being severable when they are caused to overlie each other as aforesaid;

said divider panels when adhesively connected as aforesaid to form dividers interconnecting said composite strip and said middle strips and being adapted to space the strips as the divider panels hinge from their respective panels to articulate the assembly to define four series of divided cells;

anchor flaps on the strips and on the dividers for connection to the walls of a container to impart spreading motion to the strips and dividers as the container is moved from a flat to a set-up position.

2. A divider assembly comprising:

a stack of at least three longitudinal dividers;

transverse divider flaps cut from said longitudinal dividers, hinged thereto, and juxtaposed thereto, the free ends of some divider flaps being adhesively secured whereby as the outside ones of said stack of longitudinal dividers are moved longitudinally with respect to each other said transverse divider flaps hinge to an operative position at right angles to the longitudinal dividers;

said transverse divider flaps including divider flaps that extend on each side of the longitudinal divider from which they are cut, and divider flaps that are adhesively joined to a divider flap cut from an adjacent longitudinal divider;

and anchor flaps for connecting the divider assembly to the walls of a container to impart spreading motion to the divider assembly as the container is moved from a flat to a setup position.

* * * * *